United States Patent [19]

Segalman

[11] Patent Number: 4,567,945

[45] Date of Patent: Feb. 4, 1986

[54] ELECTRODE WELL METHOD AND APPARATUS

[75] Inventor: Daniel J. Segalman, Plano, Tex.

[73] Assignee: Atlantic Richfield Co., Los Angeles, Calif.

[21] Appl. No.: 565,679

[22] Filed: Dec. 27, 1983

[51] Int. Cl.[4] ..... E21B 43/24

[52] U.S. Cl. ..... 166/248; 166/65.1; 166/280; 166/302; 166/308

[58] Field of Search ..... 166/55.1, 57, 65 R, 166/66, 248, 253, 280, 281, 292, 297, 302, 308

[56] References Cited

U.S. PATENT DOCUMENTS

| | | | |
|---|---|---|---|
| 3,149,672 | 9/1964 | Orkiszewski et al. | 166/248 |
| 3,180,748 | 4/1965 | Holmgren et al. | 166/292 X |
| 3,206,537 | 9/1965 | Steward | 166/65 R X |
| 3,502,148 | 3/1970 | Slagle et al. | 166/292 |
| 3,507,332 | 4/1970 | Venable, Jr. et al. | 166/292 |
| 3,862,662 | 1/1975 | Kern | 166/248 |
| 4,120,166 | 10/1978 | Brooks, Jr. | 166/253 X |
| 4,401,162 | 8/1983 | Osborne | 166/248 |
| 4,484,627 | 11/1984 | Perkins | 166/248 |

*Primary Examiner*—George A. Suchfield
*Attorney, Agent, or Firm*—Robert M. Betz

[57] ABSTRACT

An electrode well is described which utilizes a hydraulic fracture filled with conductive proppant as an electrode of extended contact with a formation. A highly conductive section of cement liner around the casing delivers current to the proppant particles.

7 Claims, 3 Drawing Figures

ELECTRODE WELL METHOD AND APPARATUS

BACKGROUND OF THE INVENTION

1. Field of the Invention

This invention relates generally to the application of electrical energy in the heating of subsurface hydrocarbonaceous formations including tar sands and other viscous oil bearing formations. More particularly it is concerned with a method and apparatus for accomplishing this purpose utilizing an electrode well forming part of an electric circuit extending through a formation to be heated.

2. Description of the Prior Art

Known techniques and apparatus for electrical heating of a formation typically include sinking a well or wells into a oil bearing information or into immediately adjacent layers above and below such formation. A formation-contacting electrode may be formed as part of an alternating current circuit extending through the wellbore from the surface, the circuit being completed through the formation. The electrode is typically connected to a section of conductive casing which is in turn connected to an electrical cable extending downward from a power source at the surface. When power is applied an expanding electric field is created about each such electrode the current density within such field being greatest at the electrode itself. The smaller the surface area of the electrode the greater the current density for any given power and the greater the resultant heating. If current density becomes sufficiently high at the electrode, local heating may cause formation fluids to boil off, thereby interrupting current flow and the entire heating process. In order to overcome this problem it is advantageous to enlarge the contact area between the well electrode or electrodes and the adjacent formation. Greater power may then be applied in the heating process without reaching undesirable current densities. One known technique for this purpose is to create a hydraulic fracture filled with highly conductive proppant particles as described, for example in U.S. Pat. No. 3,547,193 to Gill or U.S. Pat. No. 3,862,662 to Kern. These conductive particles when interconnected with a source of potential through the well casing constitute an electrode of considerable contact area with the formation. Utilizing a hydraulic fracture zone as an electrode lowers current density in the immediate vicinity of the electrode well, thus minimizing local heating. Nonetheless, making the fracture conductive necessarily causes some heating to occur within the fracture, thus increasing its fluid mobility and therefore enhancing production when the electrode well is used for that purpose.

Hydraulic fractures created for the purpose outlined above typically involve perforation of the conductive section of casing, such perforations being continued through the cement liner into the formation itself. In order for the conductive proppant particles, such as steel shot, for example, to function as a large area electrode a good conductive path must be established and maintained between the proppant and the casing. In creating such a fracture, after the proppant particles have been introduced, the fracture fluid is "back produced". This should cause these particles to flow back into the perforations, but there is no reliable way to establish the extent to which such perforations are actually filled in this manner. All current flow into or out of the well will be narrowly confined to the surface area of the perforations within the conductive casing itself. If the proppant fails to work down into these perforations the required current paths into the proppant are never established and the process becomes non-operative. Even if the requisite contact is made, there is the drawback that the well can not thereafter be used for production through the fracture, since a tightly plugged perforation will restrict fluid flow.

It is therefore an object of this invention to provide an improved method and apparatus for electrically heating a formation.

It is a more particular object of this invention to provide a method and apparatus for forming an electrode well of greater efficiency utilizing a hydraulic fracture.

Other and further objects and advantages of this invention will become apparent from a consideration of the detailed description and drawings to follow taken in conjunction with the appended Claims.

SUMMARY OF THE INVENTION

In accordance with the preferred embodiment of this invention an electrode well adapted to form part of an electric circuit within a formation includes a wellbore within which a casing is lowered surrounded by a cement liner. A conductive section of the casing electrically insulated from its adjacent sections extends within the formation. A section of said liner selected of a material having predetermined properties of electric conductivity surrounds said conductive casing section. Means are provided for creating a hydraulic fracture within the formation which extends outwardly from and in communication with the conductive section of the cement liner, such fracture being substantially filled with a conductive proppant. If the conductive casing section is interconnected with a source of electric potential at the surface adapted to complete an electric circuit through the formation current will flow along multiple paths between the casing section and the conductive proppant means through the conductive liner section.

The preferred embodiment of this invention also comprises the method of forming an electrode well extending into a formation and including a casing surrounded by a cement liner, said casing and liner being perforated within such formation so as to enable the creation of a hydraulic fracture extending outwardly from said well. The method comprises the steps of introducing cement of lower conductivity into the wellbore so as to form a first upper section of said liner, introducing a further body of cement of higher conductivity into said wellbore so as to form a second lower section of such liner adapted to contact the selected formation filling said hydraulic fracture with conductive proppant particles through said perforations, and interconnecting said casing with a source of electric potential, thereby establishing multiple current paths through said high conductivity section of liner between the casing and the conductive proppant particles.

DETAILED DESCRIPTION OF THE INVENTION

Figure 1:
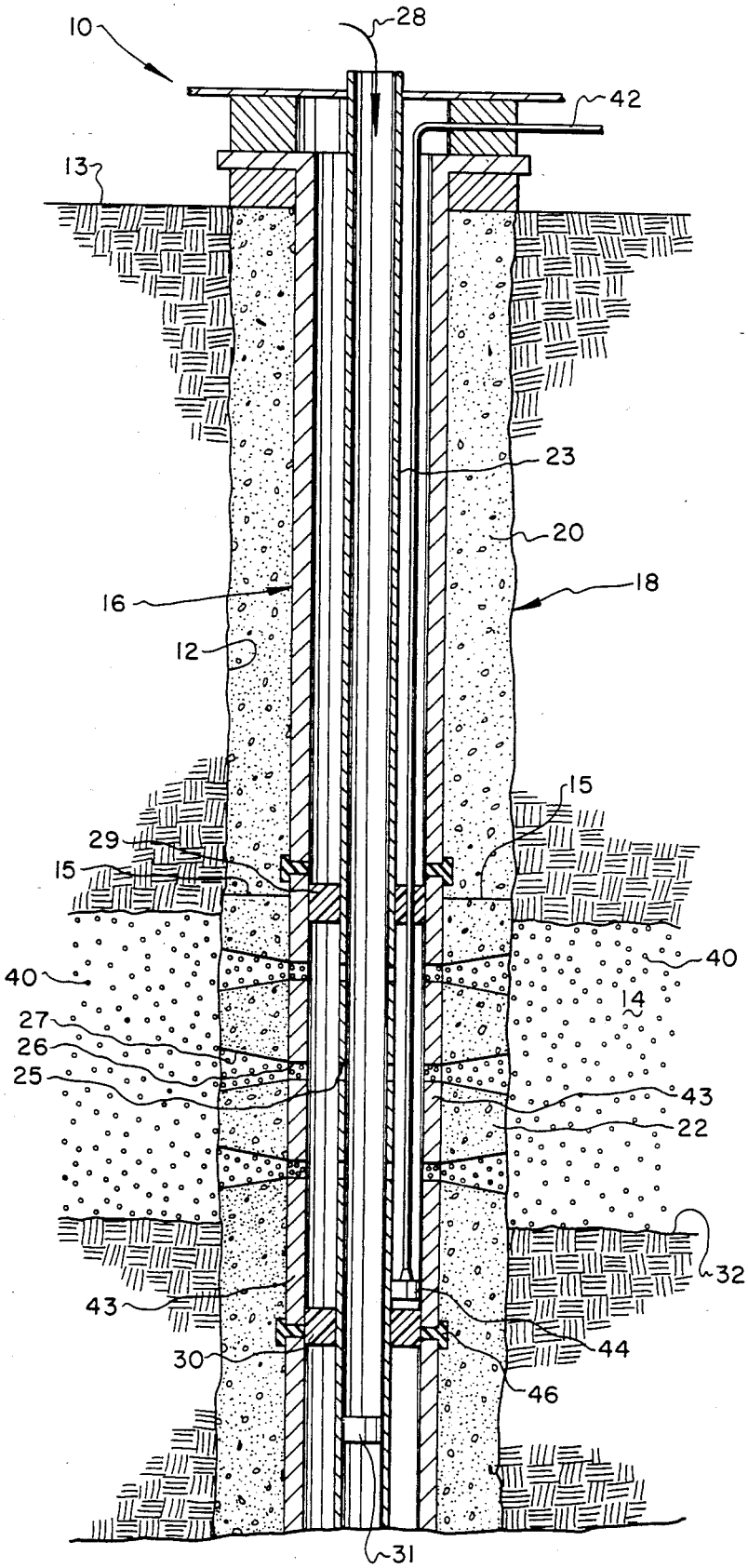
FIG. 1 is a vertical section of an electrode well in accordance with the preferred embodiment of this invention.

With particular reference now to the embodiment of FIG. 1, an electrode well 10 comprises wellbore 12 extending from the surface of the earth 13 into an electrically conductive formation of interest 14. Casing 16 within wellbore 12 is surrounded by cement liner 18 consisting of an upper section 20 above formation 12 and a lower section 22 of higher conductivity situated within formation 14. Upper section 20 and lower section 22 are joined at interface 15. Casing 16 is provided with a centralized tubing 23 also extending into formation 14.

By means well known in the art tubing 23 casing 16, and liner section 22 may be perforated at intervals within formation 14 to form a plurality of axially aligned perforations 25, 26 and 27 passing respectively through these members. Fracture fluid 28 may be introduced from the surface through centralized tubing 24 and through perforations 25, 26 and 27 in order create hydraulic fractures 32. To confine the flow of fluid 28, suitable packers 29 and 30 may be positioned between casing 16 and tubing 23 above and below formation 14 respectively, and tubing 23 may further be provided with bottom plug 31, all in accordance with well known practice. The fracture fluid serves as a vehicle to introduce conductive proppant particles 40 into fractures 32 such that particles 40 substantially fill the voids within such fractures. Material for proppant 40 may consist for example of steel shot of a size approximating 20×40 mesh sand.

Through an electrical cable 42 power may be introduced from a suitable surface source (not shown) through connector 44 establishing electrical contact with conductive casing section 43 in the vicinity of perforations 26. In order to prevent leakage of current casing section 43 may be isolated from adjacent sections above and below the formation 14 by suitable insulators 46.

Figure 2:
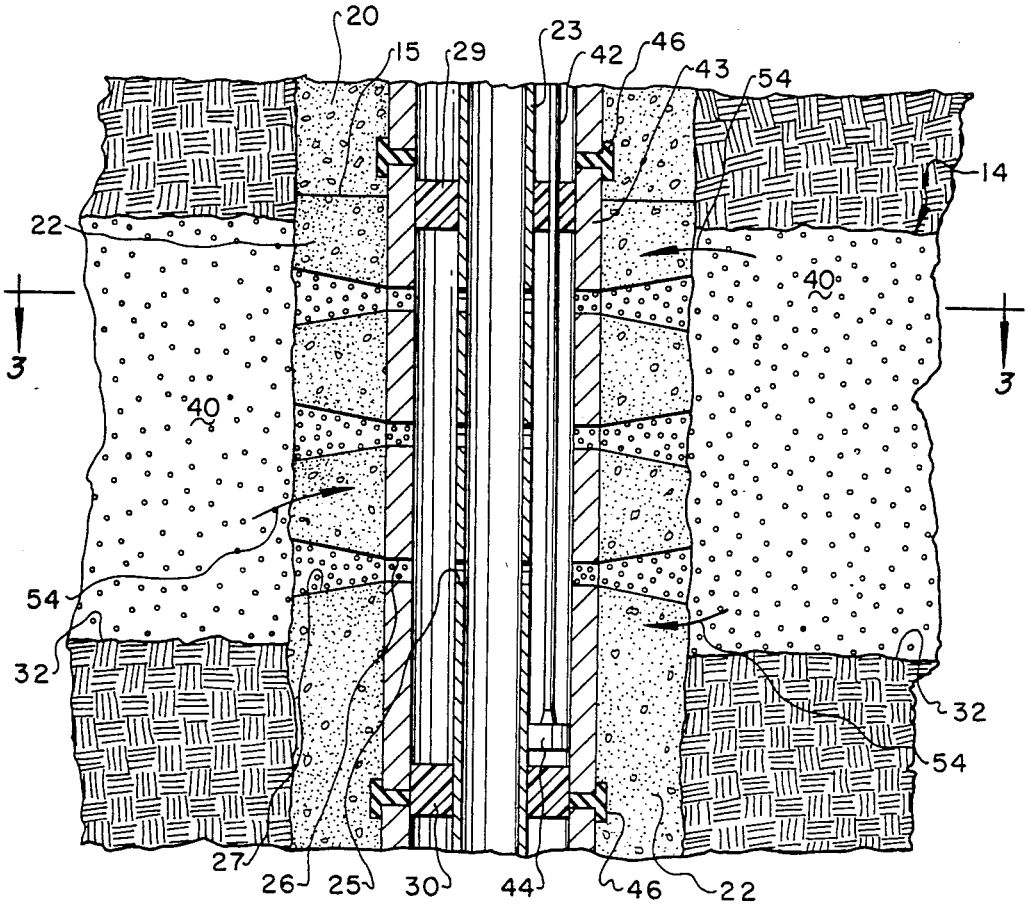
FIG. 2 is a detailed of the electrode well of FIG. 1 showing more particularly the vicinity of the perforations through the casing and cement liner.

It is apparent from a consideration of FIG. 2 that the only possible direct contact between proppant particles 40 and casing section 43 occurs at the periphery of perforations 26 passing through casing section 43. Under ordinary circumstances however, particles 40 may not, in fact fill perforations 26. If particles 40 extend only with flared perforations 27 passing through cement liner section 22 the necessary electrical contact referred to above is never achieved.

Figure 3:
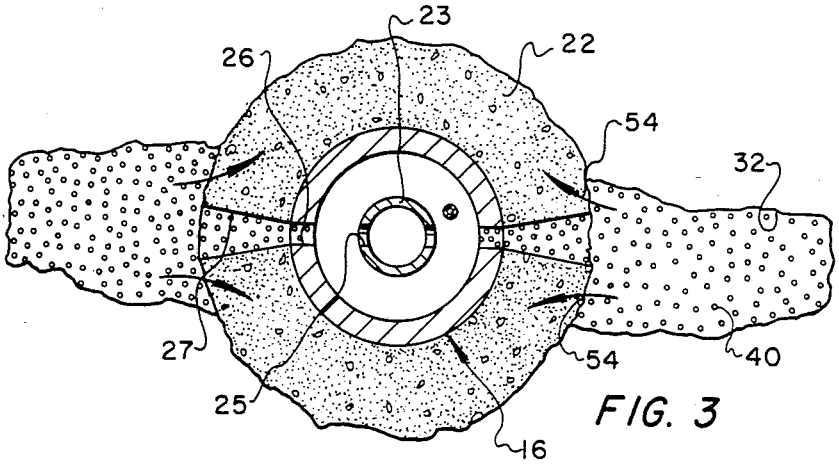
FIG. 3 is a plan view taken along the line 3—3 in FIG. 2.

The above problems are avoided in accordance with this invention as a result of making liner section 22 itself a source of multiple current paths 54 between casing section 43 and proppant particles 40. This is accomplished by employing a material in forming liner section 22 which possesses electrical conductivity of at least a minimum desired value. By limiting the conductivity of adjacent upper liner section 20 and any additional lower adjacent liner section (not shown) to a value substantially lower than that of section 22, one can substantially reduce or eliminate any leakage of current above or below formation 14. As will best be seen by examination of FIG. 3, in this way electrical paths 54 are established which completely surround casing section 43. This wide area contact avoids current build-up problem otherwise resulting from confinement of current paths to perforations 25, 26, and 27. It further avoids the possibility that no adequate contact is present between casing section 43 and proppant particles 40.

The electrode conductivity of liner section 22 may be increased by the addition of metallic particles of various shapes such as flakes, rods, or pellets. Possible materials include hematite, ilmenite, and other ferrous compounds, or shredded copper wire filings. As an example, liner section 22 may consist of 25% by weight of well mixed iron filings.

The metallic particles should be added to the cement in a slurry state, the consistency of the slurry being such as to support and maintain a uniform dispersion of the metallic particles. The total resulting density of the slurry should be such as to permit it to be properly pumped and handled in the completion of a well in accordance with this invention. If the density becomes too high it will abrade the formation and tend to breakdown. Also a higher density may also increase the risk that the hydrostatic fracture gradient into the formation will be exceeded, thus permitted the cement to be lost into the formation itself.

A further consideration in formulating a highly conductive cement for use in this invention is durability under such temperature conditions as may be predictably encountered downhole. Without stabilizors a cement typically crumbles at about 250 degrees Fahrenheit, the particular temperature depending upon the type of stresses to which it is subjected. With stabilizors it may withstand temperatures up to 650 degrees Fahrenheit. An example of such a stabilizor is a cement additive of between 30 and 40 percent silica flour. A further such formulation is class G cement.

It is reasonable to assume a certain residual amount of moisture exists within cement liner 22. A further desirable addition to the composition of a high conductivity cement in accordance with this invention therefore is salt, which will contribute to the ionic conductivity of such moisture content.

Practically speaking, a proposed cement formulation for use in this invention may be laboratory tested under triaxial load and high temperature to approximate environmental conditions. Electrical conductivity expressed as mhos per centimeter, which is the ratio of the current density to the applied electric field, may be measured in conjunction with mechanical durability after cycling several times from high to low temperatures.

For the purposes of this invention a preferred formulation for liner section 22 will have a conductivity of at least 10 mhos per centimeter, typical values ranging from $10^2$ mhos per centimeter to $10^3$ mhos per centimeter.

It is to be understood that no specific lower threshold of conductivity is intended for liner 22. It is apparent, however, that the higher such conductivity becomes the more effective and reliable the formation heating produced by proppant particles 40 as an extended area electrode.

Viewed as a method the preferred embodiment of this invention is seen generally to comprise a series of steps particularly related to an improvement in the formation of an electrode well utilizing a conductive casing and surrounding cement liner and downhole electrode means such as a hydraulic fracture filled with conductive proppant in contact with a formation of interest. The steps basically include introducing into the wellbore an upper casing liner section of lower conductivity cement followed by a lower liner section of higher conductivity cement, in contact with said formation and communicating with said hydraulic fracture, the inherent "plug" flow characteristics of cement being sufficient to prevent intermingling of the two different formulations. Those skilled in this art will have no difficulty devising electrical means such as probes and the like for determining the point of which the lower cement liner section has risen to an appropriate level within the wellbore. Within the scope of this invention the method may provide beneficial results with electrode means other than the conductive proppant particles 40, such as electrical probes or other geometric configurations adapted to contact the formation and extend the effective wellbore radius.

What has been described is illustrative only of this invention and those skilled in this art will have no difficulty in devising alternate arrangements of parts and compositions of materials within the scope of this invention as more particularly set forth in the appended Claims.

What is claimed is:

1. An electrode well adapted to form part of an electric circuit within a formation comprising:

(a) a wellbore extending from the surface into such formation;

(b) a casing within said wellbore, said casing having a conductive section situated at least partially within said formation, said section being insulated from adjacent sections of said casing;

(c) a cement liner within said wellbore, said liner having a section of predetermined electrical conductivity surrounding said conductive casing section in contact with such formation; the electrical conductivity of said section being substantially higher than that of any sections of said liner adjacent thereto;

(d) means for creating a hydraulic fracture within said formation extending outwardly from said electrode well in communication with said conductive liner section;

(e) conductive means substantially filling the void within said fracture; and (f) means for interconnecting said conductive casing section with a source of electrical potential so as to establish multiple current paths between said conductive casing section and said fracture conductive means through said conductive liner section.

2. An electrode well according to claim 1 wherein said conductive liner section is comprised of approximately 25 percent by weight of well mixed iron filings.

3. An electrode well in accordance with claim 1 wherein said conductive casing and liner sections are perforated in order to enable the creation of said fracture and wherein said multiple current paths surround said casing in the vicinity of said perforations.

4. An electrode well adapted to form part of an electric circuit within a formation comprising:

(a) a wellbore extending from the surface into such formation;

(b) a casing within said wellbore, said casing having a conductive section situated at least partially within said formation, said section being insulated from adjacent sections of said casing;

(c) a cement liner within said wellbore, said liner having a section of predetermined electrical conductivity surrounding said conductive casing section in contact with such formation;

(d) means for creating a hydraulic fracture within said formation extending outwardly from said electrode well in communication with said conductive liner section;

(e) steel shot proppant means substantially filling the void within said fracture; and (f) means for interconnecting said conductive casing section with a source of electrical potential so as to establish multiple current paths between said conductive casing section and said steel shot proppant means through said conductive liner section.

5. The method of forming an electrode well for heating a selected formation comprising the steps of:

(a) drilling a borehole from the surface into said formation;

(b) introducing a casing within said borehole extending into said formation, said casing having an electrical conductive section situated within said formation;

(c) electrically isolating said conductive casing section from casing sections adjacent thereto;

(d) introducing a first body of cement of lower electrical conductivity between the casing and the wellbore adapted to form an upper liner section;

(e) introducing thereafter a second body of cement of higher electrical conductivity in said wellbore adapted to form a lower liner section abutting said upper liner section, said lower liner section surrounding said conductive casing section in contact with said formation;

(f) creating a hydraulic fracture within said formation in communication with said lower liner section;

(g) filling said hydraulic fracture with electrical conductive means and (h) interconnecting said conductive casing section with a source of electrical potential at the surface, thereby establishing multiple current paths through said lower liner section as part of an electric circuit extending between said fracture conductive means and said conductive casing section.

6. The method of claim 5 including the step of providing electrical sensing means within said well for signaling the upper advance of said lower cement section to a predetermined level within the borehole.

7. The method of claim 5 wherein said lower section of cement liner possess a conductivity of at least ten mhos per centimeter.

* * * * *